US008770797B2

(12) United States Patent
Wang

(10) Patent No.: US 8,770,797 B2
(45) Date of Patent: Jul. 8, 2014

(54) ILLUMINATION DEVICE HAVING HEAT DISSIPATING MEANS AND LIGHT SENSOR

(76) Inventor: Chih-Chien Wang, New Taipei (TW)

( * ) Notice: Subject to any disclaimer, the term of this patent is extended or adjusted under 35 U.S.C. 154(b) by 273 days.

(21) Appl. No.: 13/455,099

(22) Filed: Apr. 24, 2012

(65) Prior Publication Data

US 2013/0279172 A1 Oct. 24, 2013

(51) Int. Cl.

| | |
|---|---|
| ***F21V 29/00*** | (2006.01) |
| ***F21V 15/01*** | (2006.01) |
| *F21S 8/08* | (2006.01) |

(52) U.S. Cl.

CPC ..... *F21V 15/011* (2013.01); *F21S 8/086* (2013.01); *F21V 29/004* (2013.01); *Y10S 362/802* (2013.01)

USPC ..... 362/294; 362/373; 362/153; 362/414; 362/431; 362/802

(58) Field of Classification Search

CPC ..... F21S 8/085; F21S 8/086; F21V 15/01; F21V 15/011; F21V 29/002; F21V 29/004; F21W 2131/103

USPC ..... 362/373, 294, 145, 153, 411, 414, 431, 362/802

See application file for complete search history.

(56) References Cited

U.S. PATENT DOCUMENTS

| | | | | |
|---|---|---|---|---|
| 5,136,493 | A * | 8/1992 | Straus et al. | 362/373 |
| 7,488,093 | B1 * | 2/2009 | Huang et al. | 362/373 |
| 7,771,087 | B2 * | 8/2010 | Wilcox et al. | 362/373 |
| 7,784,980 | B2 * | 8/2010 | Tsao et al. | 362/431 |
| 7,798,684 | B2 * | 9/2010 | Boissevain | 362/431 |
| 7,828,463 | B1 * | 11/2010 | Willis | 362/431 |
| 7,922,372 | B2 * | 4/2011 | Li | 362/373 |
| 8,177,398 | B2 * | 5/2012 | Yao | 362/373 |
| 8,523,400 | B2 * | 9/2013 | Lin et al. | 362/373 |
| 8,579,469 | B2 * | 11/2013 | Kong et al. | 362/373 |
| 8,662,717 | B2 * | 3/2014 | Sinai et al. | 362/431 |
| 2012/0127738 | A1 * | 5/2012 | DeKalb et al. | 362/373 |
| 2014/0049961 | A1 * | 2/2014 | Wilcox et al. | 362/373 |

* cited by examiner

*Primary Examiner* — Ismael Negron

(57) ABSTRACT

An illuminating device includes a heat-dissipating shroud, a heat-dissipating module, an upper cover module and a lower cover module. The heat-dissipating module includes a light source, a substrate, a heat-conducting element and heat-dissipating blades. The upper cover module includes an upper cover, a light sensor and a protective cover. The lower cover module includes a lower cover, a transparent shroud and a transformer. The heat-dissipating shroud is assembled above the heat-dissipating blades of the heat-dissipating module. A top surface of the heat-dissipating shroud is provided with heat-dissipating holes. A space of a suitable height is generated between the top surface of the heat-dissipating shroud and the heat-dissipating blades of the heat-dissipating module to act as a heat concentration chamber. A gap is formed between the bottom of the heat-dissipating shroud and the top surface of the upper cover of the upper cover module.

9 Claims, 5 Drawing Sheets

ILLUMINATION DEVICE HAVING HEAT DISSIPATING MEANS AND LIGHT SENSOR

BACKGROUND OF THE INVENTION

1. Field of the Invention

The present invention relates to an illuminating device, and in particular to an illuminating device having a heat-dissipating structure, whereby the heat generated by the illuminating device can be concentrated and dissipated by air convection. Since a greater temperature difference is generated between a heat-concentrated area inside the present invention and cool air outside the present invention, air convection is accelerated thereby to improve the heat-dissipating efficiency of the present invention. Further, the present invention has a modular structure, so that it can be assembled and manufactured more quickly.

2. Description of Prior Art

Illuminating device is very important in our daily life. For example, illuminating device provides sufficient light in a dark environment or at night, so that people can do works or activities as if they were in the daytime. Further, illuminating device plays a more important role on traffic safety, so that they can be used as traffic signals, streetlamps, automobile lights or the like. Even though there are various kinds of streetlamps, the primary purpose of each streetlamp is to provide light for people on the street. The conventional streetlamp is equipped with a bulb or an fluorescent tube to act as a light source element, which has a short lifetime and insufficient intensity. Thus, incandescent lamps, sunlight lamps, mercury-vapor lamps or sodium-vapor lamps are proposed nowadays to replace the traditional lamps. In order to develop an illuminating device which consumes less electricity, has a longer lifetime and generates sufficient intensity of light, some streetlamps are installed with high-performance light-emitting diodes to replace the traditional light source elements. No matter what kind of light source element is used, it is still an important issue to dissipate the heat generated by the light source element. Although the conventional streetlamp has a heat-dissipating structure for dissipating the heat generated by the light-emitting elements, such a conventional heat-dissipating structure cannot satisfy the needs for dissipating the heat of modern high-performance light-emitting elements. Thus, the heat-dissipating efficiency of the whole streetlamp needs to be improved. Moreover, a streetlamp having a high-performance heat-dissipating structure is a fundamental solution to extend the lifetime of the streetlamp. On the other hand, the traditional streetlamp is made by assembling a plurality of separate components. The assembly of the streetlamp involves complicated steps, so that the production rate is reduced. If the components of the streetlamp can be divided into several modules to form a modular structure, the streetlamp can be assembled and manufactured more quickly. Thus, the manufacturers in this field continuously attempt to solve this problem.

In view of the above, the present inventor proposes a novel illuminating device based on his expert experience and delicate researches.

SUMMARY OF THE INVENTION

In order to solve the above problems, an objective of the present invention is to provide an illuminating device having a high heat-dissipating efficiency and modular components.

In order to achieve the above objective, the present invention provides an illuminating device, which includes a heat-dissipating shroud, a heat-dissipating module, an upper cover module and a lower cover module. The heat-dissipating module comprises a light source, a substrate, a heat-conducting element and heat-dissipating blades. The upper cover module comprises an upper cover, a light sensor and a protective cover. The lower cover module comprises a lower cover, a transparent shroud and a transformer.

The heat-dissipating shroud is assembled above the heat-dissipating blades of the heat-dissipating module. A top surface of the heat-dissipating shroud is provided with heat-dissipating holes arranged regularly or irregularly. A space of a suitable height is generated between the top surface of the heat-dissipating shroud and the heat-dissipating blades of the heat-dissipating module to act as a heat concentration chamber. A gap is formed between the bottom of the heat-dissipating shroud and the top surface of the upper cover of the upper cover module.

The substrate is provided above the light source. The substrate is assembled in a mounting hole of the upper cover of the upper cover module. The heat-conducting element is assembled with the substrate and thus brought into contact with the substrate. The surface area of the heat-conducting element is larger than the surface area of the substrate. The heat-dissipating blades are assembled above the heat-conducting element and brought into contact with the heat-conducting element. The light source is provided below the upper cover of the upper cover module. The light source is electrically connected to the transformer of the lower cover module.

The front end of the upper cover is provided with the mounting hole in which the substrate of the heat-dissipating module is assembled. A middle portion of the upper cover is provided with a base in which the light sensor is assembled. The protective cover is mounted outside the light sensor. The light sensor is electrically connected to the light source of the heat-dissipating module and the transformer of the lower cover module. The upper cover is combined with a lower cover of the lower cover module.

The front end of the lower cover is provided with a hole in which the transparent shroud is received. The rear end of the lower cover is provided with a space in which the transformer is mounted. The lower cover is assembled with the upper cover of the upper cover module.

DETAILED DESCRIPTION OF THE INVENTION

First of all, it should be noted that the terms "combine", "connect", "assembled" used herein include, not exclusively, the combination or connection of two elements by conventional methods such as locking, engagement, insertion, adhesion, soldering, buckling, rivets or threads.

Figure 1:
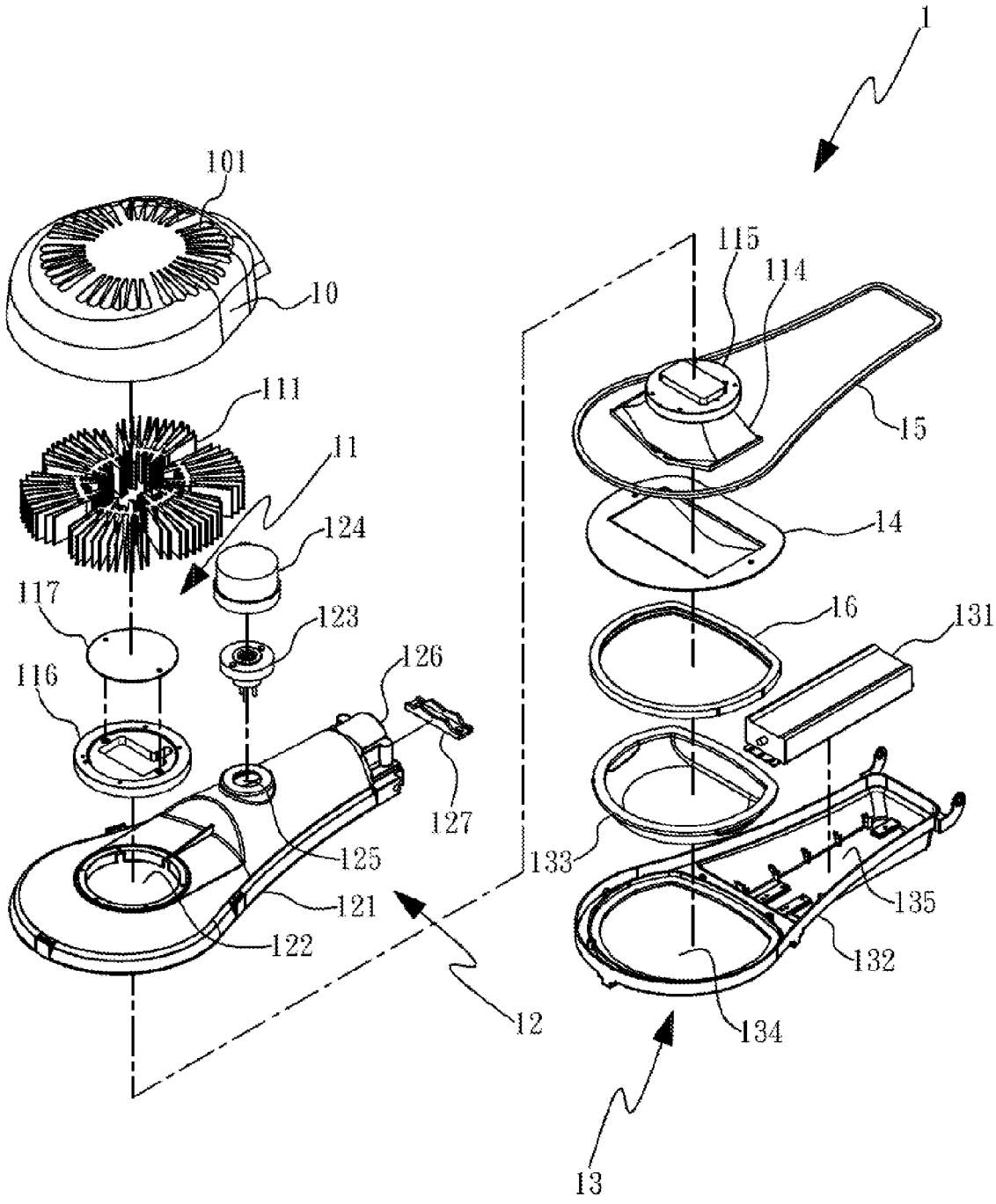
FIG. 1 is an exploded view showing the illuminating device of the present invention.
Figure 2:
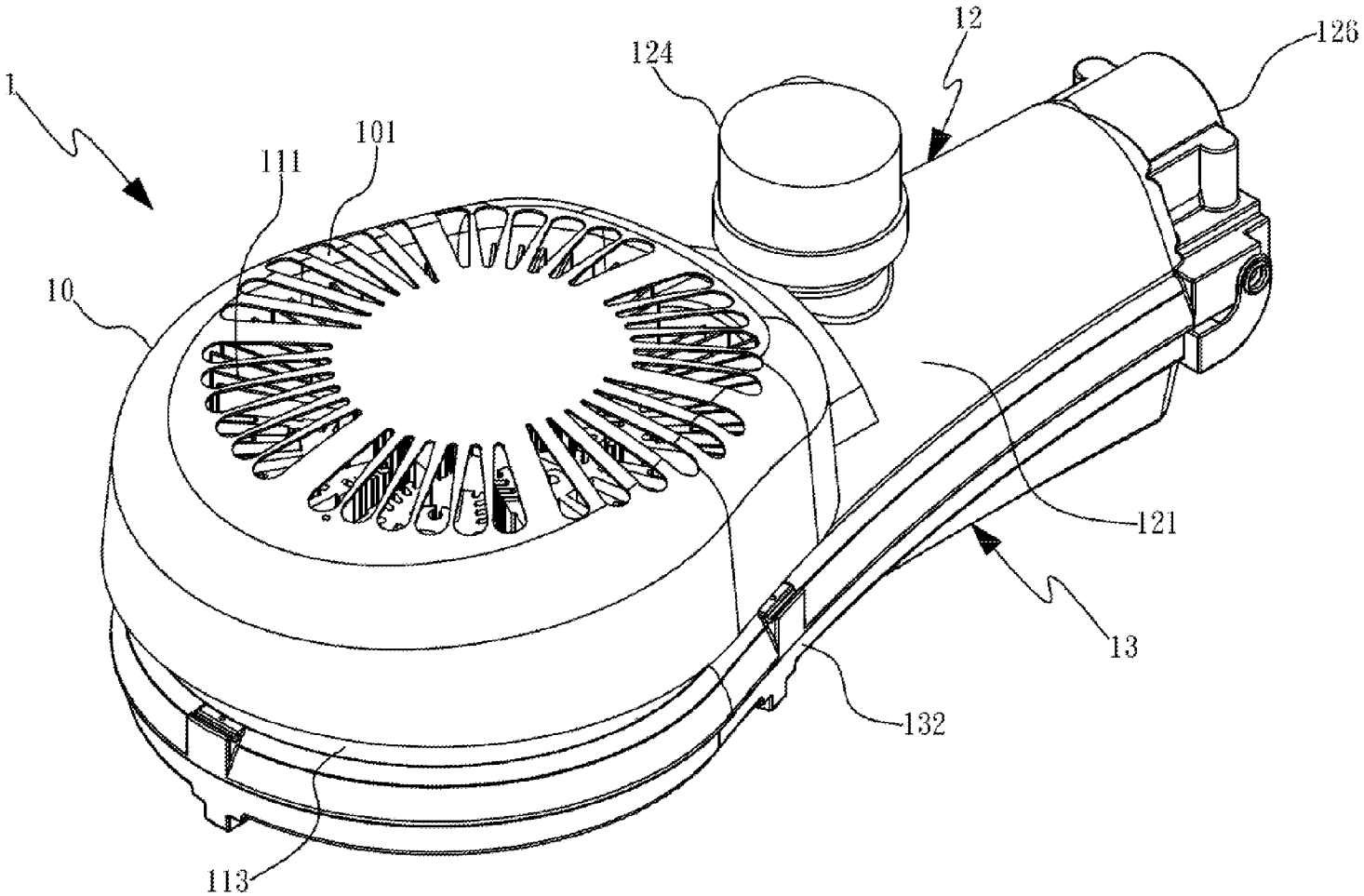
FIG. 2 is an assembled view showing the illuminating device of the present invention.
Figure 3:
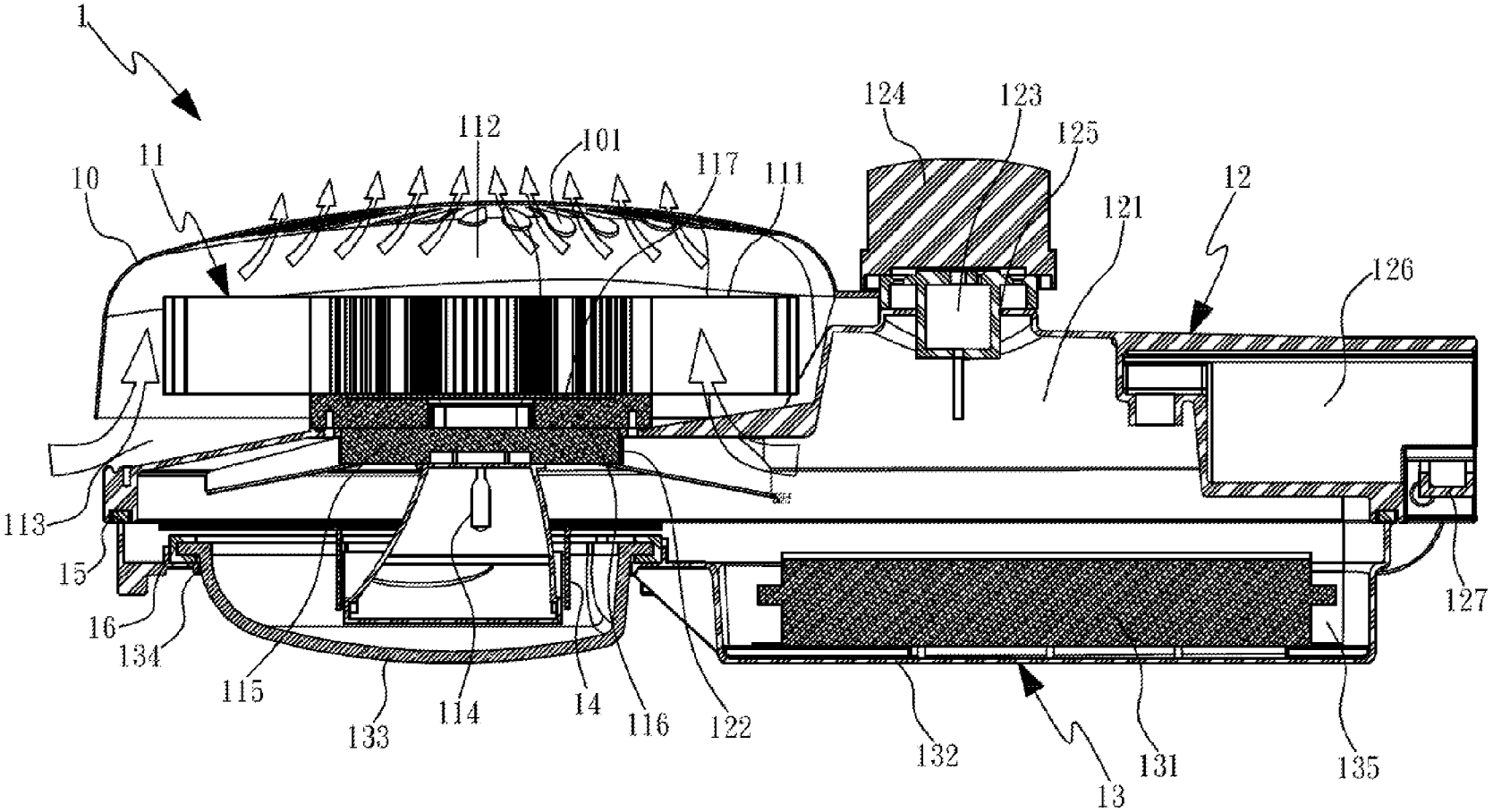
FIG. 3 is a cross-sectional view showing the illuminating device of the present invention.

Please refer to FIGS. 1 to 3, which are an exploded view, an assembled view and a cross-sectional view of the illuminating device of the present invention respectively. The present invention provides an illuminating device 1, which includes a heat-dissipating shroud 10, a heat-dissipating module 11, an upper cover module 12, and a lower cover module 13.

The heat-dissipating shroud 10 is assembled above heat-dissipating blades 111 of the heat-dissipating module 11. A top surface of the heat-dissipating shroud 10 is provided with heat-dissipating holes 101 arranged regularly or irregularly. As shown in FIG. 3, a space of a suitable height is generated between the top surface of the heat-dissipating shroud 10 and the heat-dissipating blades 111 of the heat-dissipating module 11 to act as a heat concentration chamber 112. A gap 113 is formed between the bottom of the heat-dissipating shroud 10 and the top surface of an upper cover 121 of the upper cover module 12.

The heat-dissipating module 11 comprises a light source 114, a substrate 115, a heat-conducting element 116 and the heat-dissipating blades 111. The substrate 115 is provided above the light source 114. The substrate 115 is assembled in a mounting hole 122 of the upper cover 121 of the upper cover module 12. The heat-conducting element 116 is assembled with the substrate 115 and thus brought into contact with the substrate 115. The surface area of the heat-conducting element 116 is larger than the surface area of the substrate 115. The heat-dissipating blades 111 are assembled above the heat-conducting element 116 and brought into contact with the heat-conducting element 116. The light source 114 is provided below the upper cover 121 of the upper cover module 12. The light source 114 is electrically connected to the transformer 131 of the lower cover module 13.

The upper cover module 12 comprises the upper cover 121, a light sensor 123 and a protective cover 124. The front end of the upper cover 121 is provided with the mounting hole 122 in which the substrate 115 of the heat-dissipating module 11 is assembled. A middle portion of the upper cover 121 is provided with a base 125 in which the light sensor 123 is assembled. The protective cover 124 is mounted outside the light sensor 123. The light sensor 123 is electrically connected to the light source 114 of the heat-dissipating module 11 and the transformer 131 of the lower cover module 13. The light sensor 123 is configured to sense the brightness of external light to control the ON/OFF state of the illuminating device 1. The upper cover 121 is combined with a lower cover 132 of the lower cover module 13.

The lower cover module 13 comprises the lower cover 132, a transparent shroud 133 and a transformer 131. The front end of the lower cover 132 is provided with a hole 134 in which the transparent shroud 133 is received. The rear end of the lower cover 132 is provided with a space 135 in which the transformer 131 is mounted. The lower cover 132 is assembled with the upper cover 121 of the upper cover module 12.

The illuminating device 1 further includes a light-reflecting plate 14 disposed around the light source 114 for reflecting the light emitted by the light source 114 toward the transparent shroud 133.

The illuminating device 1 further includes a first airtight plastic strip 15 disposed on a connecting side between the upper cover 121 and the lower cover 132. The first airtight plastic strip 15 generates an airtight effect between the upper cover 121 and the lower cover 132, thereby preventing the invasion of rain or foreign matters.

The illuminating device 1 further includes a second airtight plastic strip 16 disposed on a connecting side between the transparent shroud 133 and the lower cover 132. The second airtight plastic strip 16 generates an airtight effect between the transparent shroud 133 and the lower cover 132, thereby preventing the invasion of rain or foreign matters. If the transparent shroud 133 is made of glass, the second airtight plastic strip 16 can protect the periphery of the transparent shroud 133 from suffering damage due to external forces.

The rear end of the upper cover 121 is provided with a stick-connecting portion 126 which is equipped with a fixing element 127.

The illuminating device 1 further includes a heat-conducting gasket 117. The heat-conducting gasket 117 is assembled on an upper surface of the heat-conducting element 116 and located between the heat-dissipating blades 111 and the heat-conducting element 116, so that the heat-conducting gasket 117 can be brought into contact with the heat-dissipating blades 111 and the heat-conducting element 116.

Please refer to FIG. 3, which is a cross-sectional view showing the illuminating device of the present invention. When the illuminating device 1 is activated for operation, the heat generated by the light source 114 is transferred from the substrate 115 to the heat-conducting element 116 and the heat-conducting gasket 117. The heat is concentrated on the substrate 115 and absorbed by the heat-conducting element 116 and the heat-conducting gasket 117. Then, the absorbed heat is transferred to the heat-dissipating blades 111. In this way, the heat generated by the light source 114 can be dissipated to the outside. The heat-dissipating blades 111 uniformly dissipate the heat into the heat concentration chamber 112 formed between the heat-dissipating shroud 10 and the heat-dissipating blades 111. At this time, the heat is concentrated into the heat concentration chamber 112 to raise the temperature therein. Cool air enters the gap 113 formed between the bottom of the heat-dissipating shroud 10 and the top surface of the upper cover 121 of the upper cover module 12, so that air convection makes the heat to be dissipated from the heat-dissipating hole 101 of the heat-dissipating shroud 10 out of the heat-dissipating shroud 10. After the heat is dissipated, cool air continuously enters the gap 113 formed between the bottom of the heat-dissipating shroud 10 and the top surface of the upper cover 121 of the upper cover module 12, thereby forming natural air convection. When a temperature difference and a pressure difference between the hot air in the heat concentration chamber 112 and the external cool air outside the heat-dissipating shroud 10 get greater, the effect of air convection becomes more significant. In this way, the illuminating device 1 of the present invention can enhance the effect of air convection and improve the heat-dissipating efficiency thereof.

The heat-conducting element 116 and the heat-conducting gasket 117 are made of metallic materials having high heat conductivity. The most preferable material is 6063 aluminum extrusion material, and its heat conductivity is more than 200 w/ml. In comparison with ADC12 aluminum extrusion material having ideal heat conductivity of 100 w/mk, the 6063 aluminum extrusion material has a double heat-conducting effect. Thereby, the heat can be transferred from the substrate 115 upwards to generate the best efficiency in a minimum space (volume). More specifically, the surface area of the heat-conducting element 116 larger than that of the substrate 115 helps to absorb the heat generated by the substrate 115. Since hot air floats upwards more easily than cool air, the heat can be transferred by the hot air to the heat-dissipating blades 111. Each heat-dissipating blade 111 has a solid root and a forked tail. The solid root is used to absorb the heat of the heat-conducting element 116 and the heat-conducting gasket 117. Then, the absorbed heat is dissipated to the outside by vertical surfaces of the forked tail.

Figure 4:
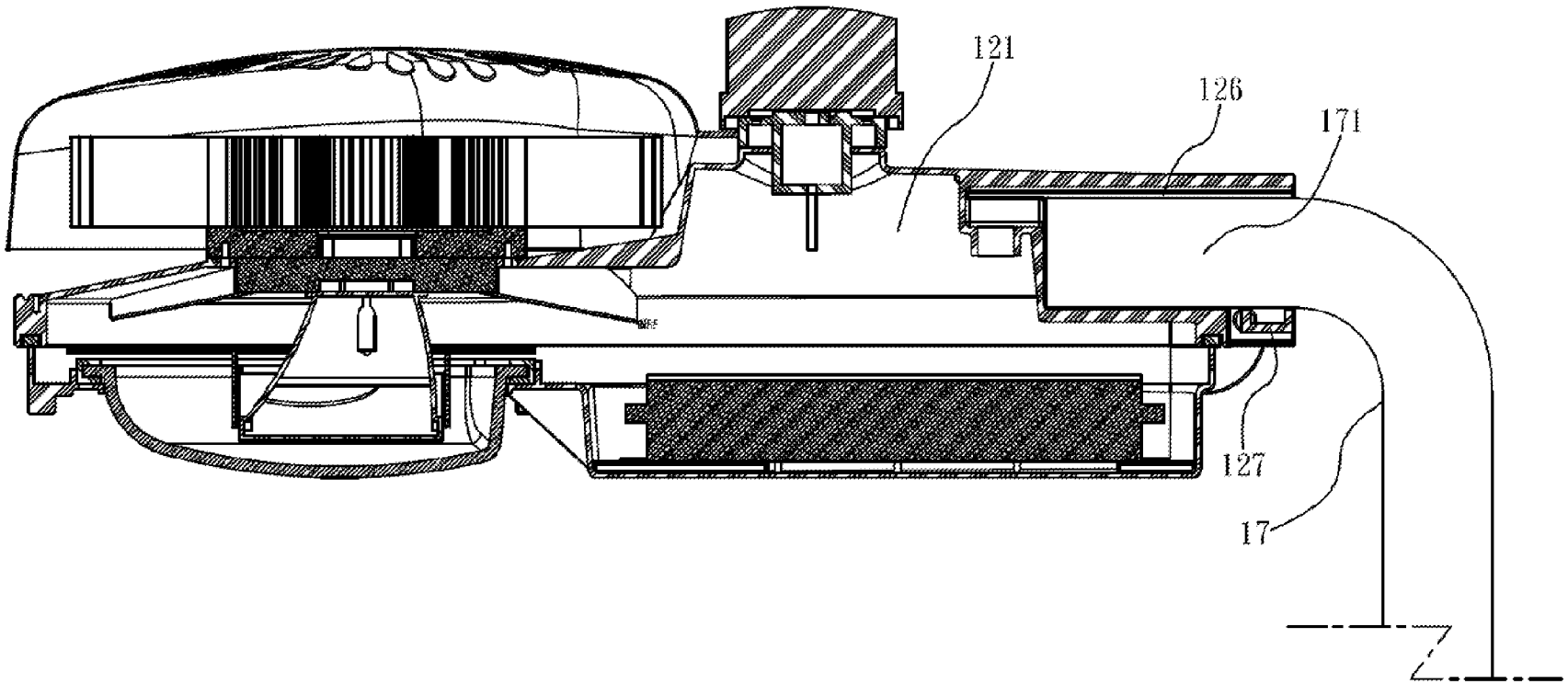
FIG. 4 is a cross-sectional view showing the illuminating device of the present invention combined with a lamp stick.

Please refer to FIG. 4, which is a cross-sectional view showing the illuminating device of the present invention combined with a lamp stick. The rear end of the upper cover 121 may be integrally formed with a lamp stick 17 or additionally assembled with a lamp stick 17. FIG. 4 shows that the lamp stick 17 is assembled with the rear end of the upper cover 121. The lamp stick 17 is formed by a bent tube having a bending angle of 90 degrees or more. A horizontal section 171 of the lamp stick 17 is inserted into the upper cover 121 to form a stick-connecting portion 126. A fixing element 127 is used to fasten the horizontal section 171 of the lamp stick 17, so that the lamp stick 17 can be combined with the upper cover 121.

Figure 5:
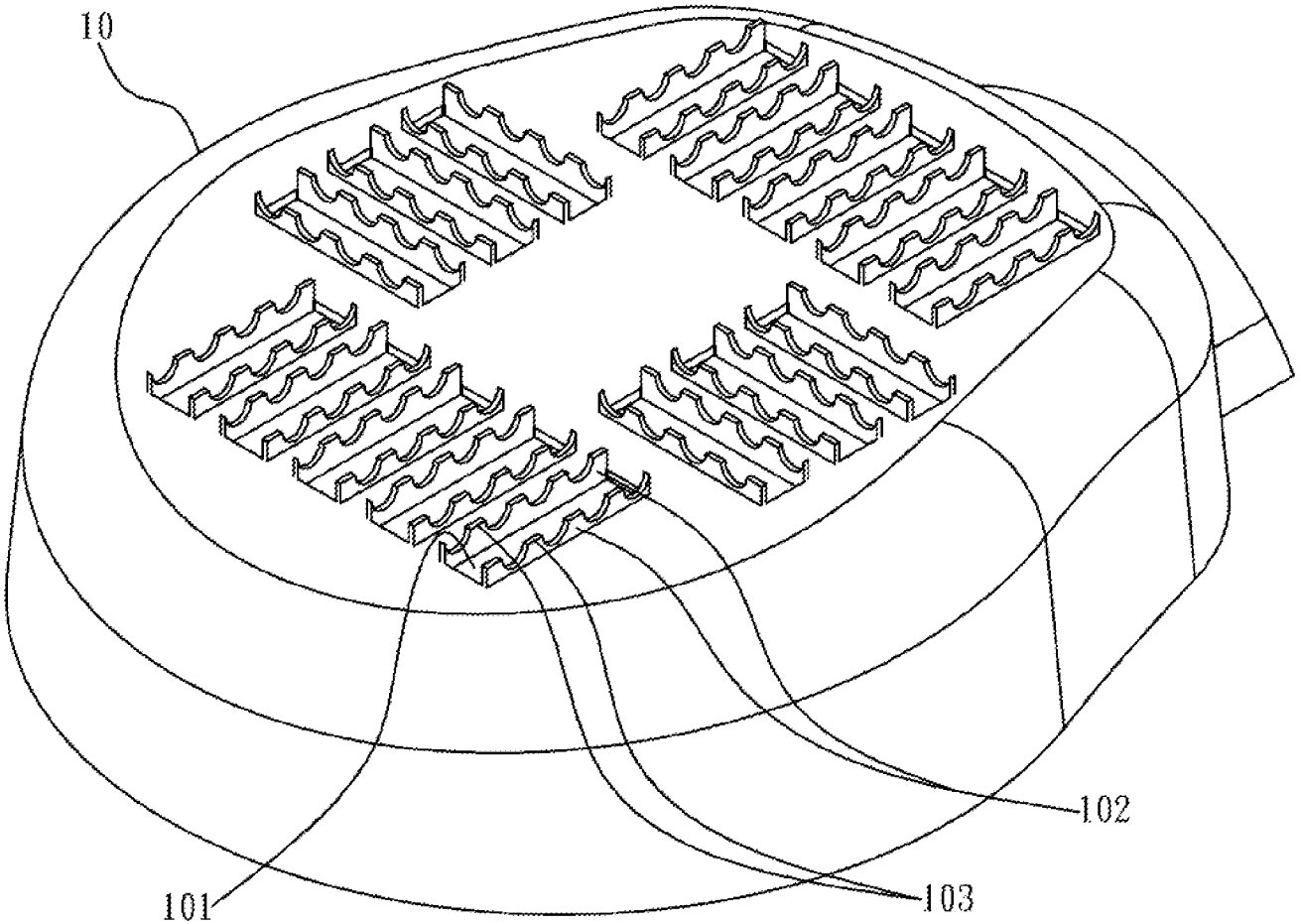
FIG. 5 is a schematic view showing the heat-dissipating shroud of the illuminating device according to another embodiment of the present invention.

Please refer to FIG. 5, which is a schematic view showing the heat-dissipating shroud 10 of the illuminating device 10 according to another embodiment of the present invention. The heat-dissipating shroud 10 is provided with upright pawls 102 along edges of the heat-dissipating holes 101 in a direction perpendicular to the heat-dissipating holes 101. Detents 103 of the upright pawls 102 may be provided to be staggered to each other, thereby preventing against the stay of animals and the invasion of foreign matters.

According to the above, the illuminating device of the present invention has advantageous features as follows:

(I) The present invention has a simple structure, so that it can be manufactured more quickly with a less cost. The present invention employs a natural principle that hot air floats upwardly than cool air.

(II) The heat is concentrated, so that the dimension of the illuminating device can be reduced to thereby save materials.

(III) Natural air convection is employed. Even there is not air convection in external environment, the illuminating device of the present invention can still generate a temperature difference and a pressure difference so as to generate natural air convection.

(IV) The present invention has a modular structure. All components of the present invention can be divided into several modules, so that it is easy for assembly and maintenance.

(V) The present invention has an independent heat-dissipating module. The heat-dissipating module is separated from the whole structure of the present invention, so that the heat-dissipating module can be independently mounted to the illuminating device of the present invention having different shapes.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An illuminating device, including a heat-dissipating shroud, a heat-dissipating module, an upper cover module and a lower cover module, the heat-dissipating module comprising a light source, a substrate, a heat-conducting element and heat-dissipating blades, the upper cover module comprising an upper cover, a light sensor and a protective cover, the lower cover module comprising a lower cover, a transparent shroud and a transformer, wherein:

the heat-dissipating shroud is assembled above the heat-dissipating blades of the heat-dissipating module, a top surface of the heat-dissipating shroud is provided with heat-dissipating holes arranged regularly or irregularly, a space of a suitable height is generated between the top surface of the heat-dissipating shroud and the heat-dissipating blades of the heat-dissipating module to act as a heat concentration chamber, a gap is formed between the bottom of the heat-dissipating shroud and the top surface of the upper cover of the upper cover module;

the substrate is provided above the light source, the substrate is assembled in a mounting hole of the upper cover of the upper cover module, the heat-conducting element is assembled with the substrate and thus brought into contact with the substrate, the surface area of the heat-conducting element is larger than the surface area of the substrate, the heat-dissipating blades are assembled above the heat-conducting element and brought into contact with the heat-conducting element, the light source is provided below the upper cover of the upper cover module, the light source is electrically connected to the transformer of the lower cover module;

a front end of the upper cover is provided with the mounting hole in which the substrate of the heat-dissipating module is assembled, a middle portion of the upper cover is provided with a base in which the light sensor is assembled, the protective cover is mounted outside the light sensor, the light sensor is electrically connected to the light source of the heat-dissipating module and the transformer of the lower cover module, the upper cover is combined with a lower cover of the lower cover module;

a front end of the lower cover is provided with a hole in which the transparent shroud is received, a rear end of the lower cover is provided with a space in which the transformer is mounted, the lower cover is assembled with the upper cover of the upper cover module.

2. The illuminating device according to claim 1, further including a light-reflecting plate disposed around the light source for reflecting the light emitted by the light source toward the transparent shroud.

3. The illuminating device according to claim 1, further including a first airtight plastic strip disposed on a connecting side between the upper cover and the lower cover.

4. The illuminating device according to claim 1, further including a second airtight plastic material disposed on a connecting side between the transparent shroud and the lower cover.

5. The illuminating device according to claim 1, wherein the rear end of the upper cover is provided with a stick-connecting portion, and the stick-connecting portion is equipped with a fixing element.

6. The illuminating device according to claim 1, wherein the heat-dissipating module further comprises a heat-conducting gasket assembled on an upper surface of the heat-conducting element and located between the heat-dissipating blades and the heat-conducting element, the heat-conducting gasket is brought into contact with the heat-dissipating blades and the heat-conducting element.

7. The illuminating device according to claim 1, wherein the rear end of the upper cover is integrally formed with a lamp stick.

8. The illuminating device according to claim 1, wherein the heat-dissipating shroud is provided with upright pawls along edges of the heat-dissipating holes in a direction perpendicular to the heat-dissipating holes.

9. The illuminating device according to claim 8, wherein the upright pawls are provided with detents staggered to each other.

* * * * *